US006258011B1

(12) United States Patent
Wolfe

(10) Patent No.: US 6,258,011 B1
(45) Date of Patent: Jul. 10, 2001

(54) WALL APPARATUS FOR SUPPORTING AN EXERCISE DEVICE

(76) Inventor: Kedric R. Wolfe, 4456 16th. St. NW., Canton, OH (US) 44708

( * ) Notice: Subject to any disclaimer, the term of this patent is extended or adjusted under 35 U.S.C. 154(b) by 0 days.

(21) Appl. No.: 09/444,236

(22) Filed: Nov. 20, 1999

(51) Int. Cl.[7] ..... A63B 21/00

(52) U.S. Cl. ..... 482/23; 482/904; 482/39; 482/117

(58) Field of Search ..... 24/667, 666, 701, 24/116 A; 482/904, 91, 23, 117, 39

(56) References Cited

U.S. PATENT DOCUMENTS

| | | | | |
|---|---|---|---|---|
| 1,079,411 | * | 11/1913 | Holmcrans . | |
| 1,205,053 | * | 11/1916 | Steiner . | |
| 2,403,057 | * | 7/1946 | Davis . | |
| 3,211,409 | | 10/1965 | Zimmermann | 248/203 |
| 3,593,708 | | 7/1971 | Steele | 128/75 |
| 4,304,403 | | 12/1981 | Wilson | 273/55 |
| 4,477,073 | | 10/1984 | Koch | 272/93 |
| 4,492,373 | | 1/1985 | Dzitzer | 272/61 |
| 5,066,002 | | 11/1991 | Cordell | 272/93 |
| 5,209,712 | | 5/1993 | Ferri | 482/91 |
| 5,518,486 | | 5/1996 | Sheeler | 482/131 |
| 5,558,607 | | 9/1996 | Darling | 482/95 |

* cited by examiner

*Primary Examiner*—Jerome Donnelly
(74) *Attorney, Agent, or Firm*—W. D. English, III

(57) ABSTRACT

A wall-mounted support structure for supporting an exercise device, including front and back metal plates disposed in parallel relation on respective sides of the wall and secured together by bolts passing through the wall, a vertically elongated chamber formed therein inside the wall between the plates, a metal ball attached to the exercise device, the front plate having an upper opening large enough to admit the ball into the chamber and a lower opening that is too small to admit the ball, the openings being contiguous so that when the ball is inserted through the upper opening it may drop down within the chamber behind the lower opening and will then be confined behind the front plate; a spring also is provided inside the chamber to retain the ball in a captured position.

3 Claims, 2 Drawing Sheets

WALL APPARATUS FOR SUPPORTING AN EXERCISE DEVICE

FIELD OF THE INVENTION

The present invention relates to exercise equipment, and particularly the support of such equipment from a wall of a building.

BACKGROUND OF THE INVENTION

During exercises it is desirable to be able to utilize a strap, rope, or parallel bar that is firmly supported from a wall. Such support needs to be able to withstand not only large static loads, but large dynamic loads as well.

Further, it is desirable to be able to detach the exercise device from the support when the exercise is over.

SUMMARY OF THE INVENTION

According to the present invention I provide a support structure that can be installed in a wall on a permanent basis, and is reliable and convenient when used to support a strap or rope during Yoga exercises, or a ballet bar.

More particularly, my support structure is capable of supporting very large loads both statically and dynamically.

According to one feature of my invention the strap or rope or ballet bar used during the exercise is easily detachable from the wall support.

Further in accordance with my invention both the static and the dynamic support of the exercise device are entirely secure at all times during the exercise, despite the fact that the exercise device may be easily disconnected afterwards.

DRAWING SUMMARY

DESCRIPTION OF PREFERRED EMBODIMENT

(FIGS. 1–4)

Figure 3:
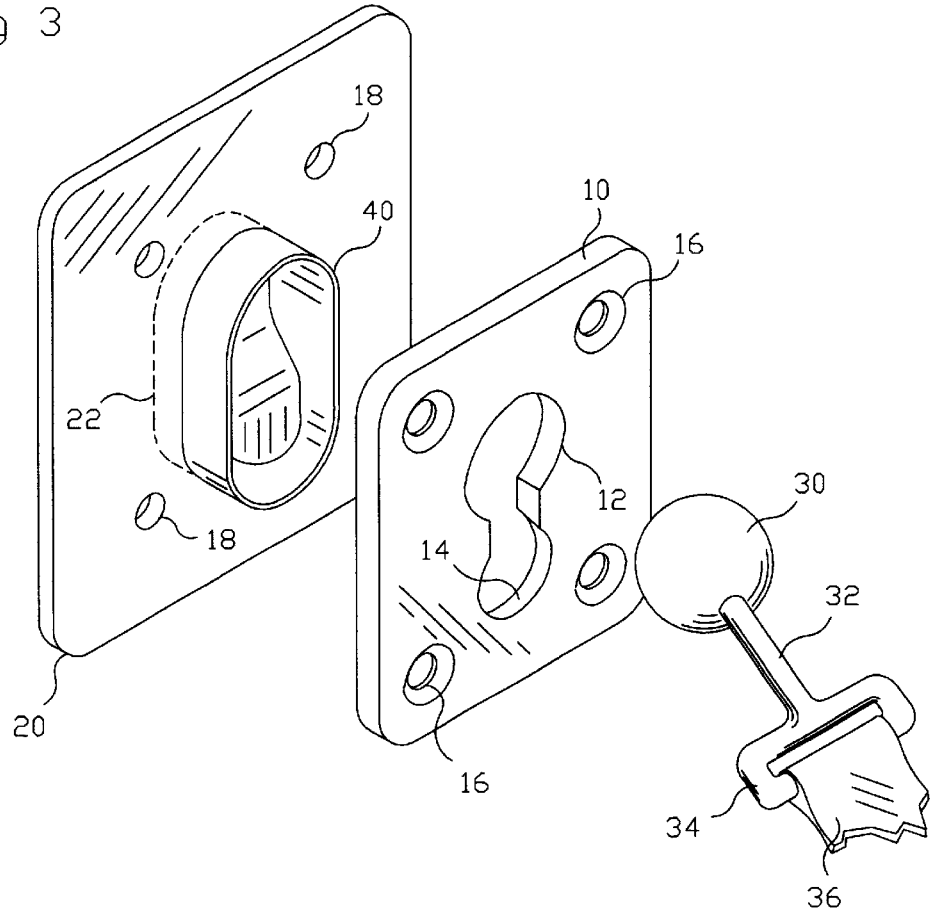
FIG. 3 is an exploded perspective view of the apparatus prior to its installation in a wall.

Referring now specifically to FIG. 3, the wall-mounted support structure of my invention includes a front plate 10 and a back plate 20. Also shown in FIG. 3 is a metal ball 30 attached to one end of rod 32 having a handle 34 for supporting a strap 36.

Figure 2:
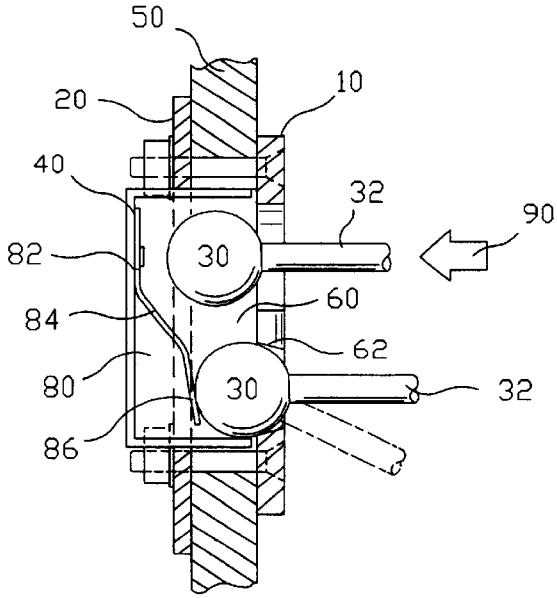
FIG. 2 is a vertical cross-sectional view taken on Line 2—2 of FIG. 1, showing the apparatus in fully assembled form.
Figure 4:
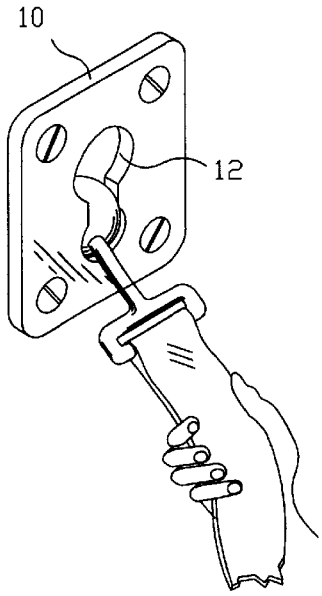
FIG. 4 is a perspective view showing interaction of the front plate, ball and rod, and operator's hand on the strap.

Front plate 10 has an upper opening 12 and a lower opening 14, the upper opening 12 being large enough to admit the ball 30 but the lower opening 14 being too small for that purpose. The openings 12 and 14 are contiguous so that they are in fact a single vertically extending opening. When the ball 30 is inserted through the upper opening 12 it may drop down behind the lower opening 14, and the metal rod 32 will then extend through the lower opening 14 as indicated in FIGS. 2 and 4. Front plate 10 is an otherwise continuous plate except for a set of bolt holes 16.

Back plate 20 is essentially square, like the front plate 10, but somewhat larger. It has a set of matching bolt holes 18. Back plate 20 also has a vertically elongated opening 22 which is generally elliptical in shape, although more specifically the shape of each end conforms to a half-circle. The dotted lines 22 in FIG. 3 indicate the location of opening 22 at the rear face of back plate 20.

A metallic restraining member 40 fills the opening 22 in back plate 20 and is firmly secured to back plate 20 as by welding. Restraining member 40 is continuous in length and has a width which is preferably somewhat more than the width of the building wall 50 into which the structure is to be installed. Member 40 also has a back or bottom wall that projects behind the back plate 20.

Figure 1:
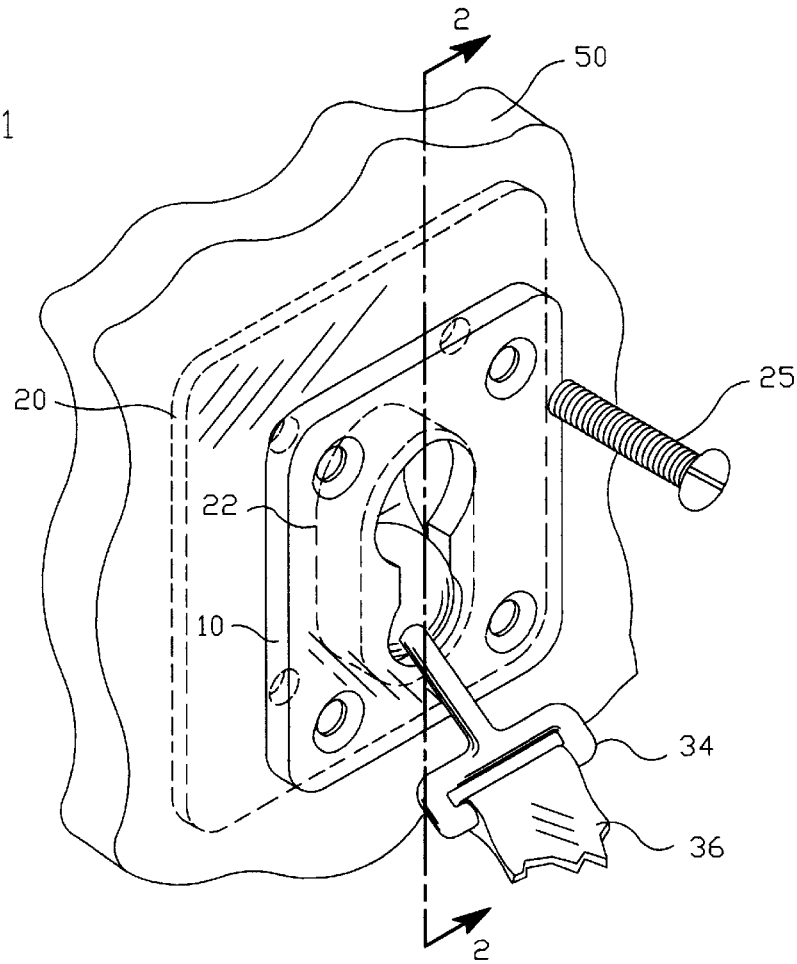
FIG. 1 is a perspective view of my apparatus in partially disassembled form with its front plate attached to he near side of a wall, showing in dotted lines the support plate attached to the rear side of the wall, and a fragmentary part of a strap used during Yoga exercises.

The wall 50, FIGS. 1 and 2, has a vertically elongated recess formed therein between the plates for receiving metallic restraining member 40. Thus, when the restraining member 40 is inserted into the wall 50 from its back side, and the two plates 12 and 14 are secured in parallel and sandwiched together by a set of bolts 25, the restraining member 40 then defines a chamber 60 inside the wall 50. As best shown in FIG. 2 the restraining member 40 then extends rearwardly through wall 50, the opening 22 in back plate 10, and also extends somewhat rearwardly of back plate 14.

The purpose of chamber 60 inside the restraining member 40 is to contain and control the operation of ball 30. Upper opening 12 will allow the ball to be inserted through front plate 10; the lower opening 14 being enlarged somewhat on the rear face of the plate to provide a socket for securely supporting the ball, as indicated by numeral 62 in FIG. 2.

A single leaf spring 80 within the chamber 60 has two ends 82, 86, offset relative to each other. The upper end 82 is secured to the back wall of member 40 behind the upper opening 12 in front plate 10, while the lower end 86 projects behind the lower opening 14 in the front plate. The two offset ends of the spring are joined by a sloped central section 84.

Arrow 90 in FIG. 2 indicates insertion of ball 30 into chamber 60. When the ball drops down or is pushed down it briefly engages the sloping section 84 of spring 80. Then when it arrives behind the lower opening 14 in front plate 10 it becomes partially inserted into that opening, and even more so because of the enlargement 62 on the rear side of the opening.

The purpose of spring 80 is to bias the ball 30 into the socket 14, 62, to prevent its escape, and so that the static and dynamic loads on the ball during Yoga exercises will be confined to the pocket. The ball nevertheless is releasable by raising the metal rod 32 from the lower into the upper opening of front plate 10 while pushing it inward to overcome the spring pressure. The ball may then be removed through the upper opening 12.

While I have shown a spring that is supported directly from the back plate 20, it may if desired be shaped somewhat differently and supported from one of the other parts.

While I have shown the restraining member 40 as extending around the entire periphery of chamber 60, it may if desired be extended only about the lower end and sides of the perimeter of the chamber for confining movement of the ball within the chamber.

Alternatively, a pair of devices in accordance with the invention may be used to support a horizontal ballet bar. Other modifications will be apparent to those skilled in the art.

While the presently preferred embodiment of my invention has been disclosed in detail in order to comply with the requirements of the patent laws, it will nevertheless be understood that my invention is to be limited only in accordance with the appended claims of invention.

What I claim is:

1. Apparatus useable during Yoga exercises for supporting a strap that is subject to relatively violent static and dynamic loads, the apparatus comprising:

a buckle for receiving the strap;

a metal rod having one end secured to the buckle and a metal ball attached to its other end;

a support structure having front and back metal plates disposed in parallel relation on respective sides of a wall of a building and secured together by bolts passing through that wall;

the wall having a vertically elongated chamber formed therein between the plates for receiving and controlling the operation of the ball;

the front plate having upper and lower openings that communicate with the chamber, the upper opening being large enough to admit the ball into the chamber but the lower opening being too small to admit the ball;

the openings being contiguous so that when the ball is inserted through the upper opening it may drop down within the chamber behind the lower opening and the metal rod will then extend through the lower opening;

a metallic restraining member, being generally continuous and of generally elliptical shape, rigidly secured to the rear plate and extending about at least the lower end and sides of the perimeter of the chamber for confining movement of the ball within the chamber;

spring means within the chamber for biasing the ball against the rear surface of the front plate adjacent its lower opening so as to provide a socket for capturing the ball and avoiding its inadvertent escape;

wherein the lower opening in the front plate is enlarged somewhat on the rear face of the plate so as to more nearly accommodate the diameter of the ball, while providing a secure socket for its support: and the ball nevertheless being releasable by raising the metal rod from the lower into the upper opening while pushing it to overcome the spring pressure so that the ball may then be removed through the upper opening.

2. Apparatus for supporting a strap or other device during exercises, the apparatus comprising:

a buckle for receiving the strap;

a metal rod having one end secured to the buckle and a metal ball attached to its other end;

a support structure having front and back metal plates disposed in parallel relation on respective sides of a wall of a building and secured together by bolts passing through that wall;

the wall having a vertically elongated chamber formed therein between the plates for receiving and controlling the operation of the ball;

the front plate having upper and lower openings that communicate with the chamber, the upper opening being large enough to admit the ball into the chamber but the lower opening being too small to admit the ball;

the openings being contiguous so that when the ball is inserted through the upper opening it may drop down within the chamber behind the lower opening and the metal rod will then extend through the lower opening, the lower opening in the front plate being enlarged somewhat on the rear face of the plate so as to provide a secure socket for supporting the ball;

a metallic restraining member of generally elliptical shape rigidly secured to the rear plate and extending about the perimeter of the chamber for confining movement of the ball within the chamber, the rear plate being continuous except for bolt holes;

a single leaf spring within the chamber having two ends offset relative to each other, the upper end being secured to the back plate behind the upper opening in the front plate while the lower end projects behind the lower opening in the front plate for biasing the ball into the socket to prevent its escape; and the ball nevertheless being releasable by raising the metal rod from the lower into the upper opening while pushing it to overcome the spring pressure so that the ball may then be removed through the upper opening.

3. A wall-mounted support structure for supporting a metal ball having a metal rod connected thereto, the structure comprising:

the wall having front and back surfaces, and the support structure including front and back metal plates disposed in parallel relation on respective sides of the wall and secured together by bolts passing through the wall;

the wall having a vertically elongated chamber formed therein between the plates for receiving and controlling the operation of the ball;

the front plate having upper and lower openings that communicate with the chamber, the upper opening being large enough to admit the ball into the chamber but the lower opening being too small to admit the ball, the lower opening being enlarged somewhat on the rear face of the plate to provide a socket for securely supporting the ball;

the openings being contiguous so that when the ball is inserted through the upper opening it may drop down within the chamber behind the lower opening and the metal rod will then extend through the lower opening;

a restraining member secured to one plate and extending about the lower end and sides of the perimeter of the chamber for confining movement of the ball within the chamber;

spring means within the chamber and rigidly secured to one of the plates for biasing the ball against the socket to prevent its inadvertent escape;

the ball nevertheless being releasable by raising the metal rod from the lower into the upper opening while pushing it to overcome the spring pressure so that the ball may then be removed through the upper opening.

* * * * *